US005299606A

United States Patent [19]

Schrupp

[11] Patent Number: 5,299,606

[45] Date of Patent: Apr. 5, 1994

[54] SYSTEM FOR HERMETICALLY DISPENSING AND DILUTING A CONCENTRATED CHEMICAL

[76] Inventor: Earl H. Schrupp, 7611 36th Ave. North, New Hope, Minn. 55428

[21] Appl. No.: 892,690

[22] Filed: May 27, 1992

Related U.S. Application Data

[63] Continuation of Ser. No. 529,921, May 29, 1990, abandoned.

[51] Int. Cl.[5] ..... B67C 9/00

[52] U.S. Cl. ..... 141/91; 141/18; 141/106; 141/330; 141/364; 134/166 R; 222/133; 222/148; 222/158; 239/74, 113, 309

[58] Field of Search ..... 141/2, 18, 21, 22, 85, 141/89-91, 94-96, 100, 104-107, 329, 330, 363-366; 134/166 R, 169 R; 239/74, 106, 112, 113, 309; 222/80-83.5, 88, 89, 91, 133, 148, 149, 151, 154, 158; 137/330, 331, 333

[56] References Cited

U.S. PATENT DOCUMENTS

| | | | |
|---|---|---|---|
| 1,948,306 | 2/1934 | Meurer | 299/90 |
| 2,167,866 | 8/1939 | Bennett | 299/95 |
| 2,203,710 | 6/1940 | Young | 222/82 |
| 2,242,857 | 5/1941 | Fortuin | 229/62 |
| 2,408,774 | 10/1946 | Goddard et al. | 244/134 |
| 2,420,223 | 5/1947 | Brewer | 299/95 |
| 3,088,652 | 5/1963 | Berven | 229/56 |
| 3,166,096 | 1/1965 | Lang | 137/564.5 |
| 3,244,331 | 4/1966 | Kharasch | 222/211 |
| 3,251,420 | 5/1966 | Rodgers | 169/31 |
| 3,367,353 | 2/1968 | Hunter | 222/133 X |
| 3,517,885 | 6/1970 | Blake | 239/309 |
| 3,587,968 | 6/1971 | Hennart et al. | 239/47 |
| 3,833,177 | 9/1974 | Pasley et al. | 239/309 X |
| 3,940,063 | 2/1976 | Baumgartner et al. | 141/18 X |
| 4,161,197 | 7/1979 | Stevenson | 141/18 |
| 4,166,481 | 9/1979 | Farris et al. | 141/91 X |
| 4,171,710 | 10/1979 | Boynton et al. | 141/104 X |
| 4,195,672 | 4/1980 | Freeman | 141/91 |
| 4,285,445 | 8/1981 | Vander Molen et al. | 222/133 X |
| 4,313,501 | 2/1982 | Eckert | 169/58 |
| 4,371,114 | 2/1983 | Weiperth et al. | 239/309 |
| 4,386,637 | 6/1983 | Buchanan et al. | 141/85 X |
| 4,465,183 | 8/1984 | Saito et al. | 206/222 |
| 4,614,267 | 9/1986 | Larkin . | |
| 4,741,437 | 5/1988 | Gorski et al. | 206/222 |
| 4,793,476 | 12/1988 | Schrupp | 206/222 |
| 4,905,871 | 3/1990 | Dutertre | 222/148 |
| 4,979,677 | 12/1990 | Dankert | 239/112 X |
| 5,062,459 | 11/1991 | Schrupp | 141/91 |

OTHER PUBLICATIONS

Brighton Crop Protection Conference, Weeds-1989, -Nov. 20, 1989 Proceedings vol. 2, 6B-7, pp. 649-656.

*Primary Examiner*—J. Casimer Jacyna

*Attorney, Agent, or Firm*—Merchant, Gould, Smith, Edell, Welter & Schmidt

[57] ABSTRACT

A system for hermetically dispensing and diluting a concentrated chemical from a container into a dilution tank which includes (i) a first portion for attachment to the container which includes a valve for controlling fluid flow from the container through the first portion, (ii) a second portion for attachment to a source of pressurized water and a measuring receptacle which includes a valve for controlling fluid flow from the source of pressurized water through the second portion and a valve for controlling fluid flow through the second portion into the receptacle, (iii) a coupler for attaching the first and second portions so as to provide fluid flow from the container to the measuring receptacle, and (iv) a valve over an outlet orifice in the receptacle for controllably releasing the contents of the receptacle into a dilution tank.

16 Claims, 3 Drawing Sheets

FIG.3
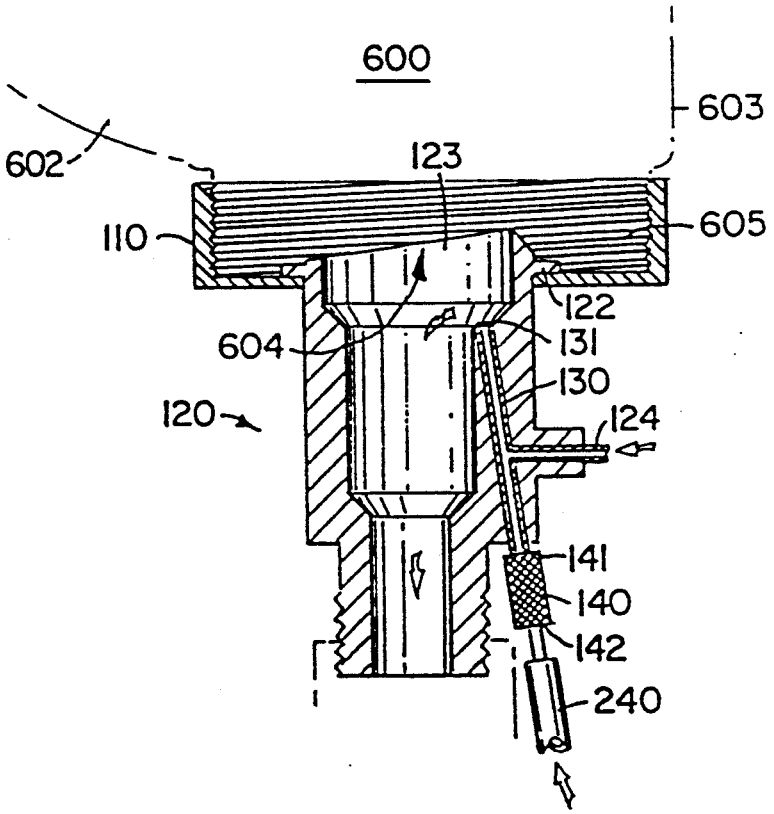
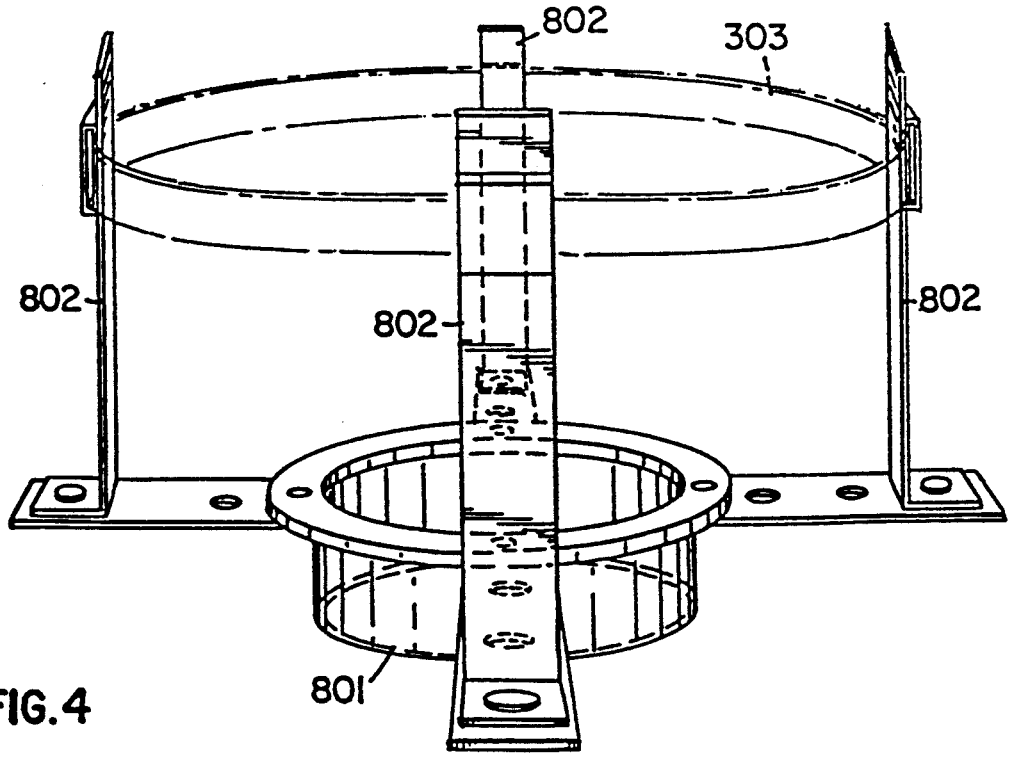
FIG.4

SYSTEM FOR HERMETICALLY DISPENSING AND DILUTING A CONCENTRATED CHEMICAL

This is a continuation of application Ser. No. 07/529,921, filed May 29, 1990, which was abandoned upon the filing hereof.

FIELD OF THE INVENTION

Broadly, the invention relates to systems for dispensing a concentrated chemical into a dilution tank. Specifically, the invention relates to systems for hermetically dispensing and diluting a concentrated chemical which includes a means for hermetically rinsing the concentrated chemical container.

BACKGROUND OF THE INVENTION

Potentially hazardous chemicals, such as pesticides and herbicides, are generally sold in concentrated form in order to avoid the complications associated with the shipping and handling of large quantities of water. The concentrated chemical is then diluted on-site by the end-user to use strength. Generally, exposure to the concentrated form of such chemicals is more hazardous than exposure to the diluted form. Hence, the process of diluting a potentially hazardous concentrated chemical is one of the more dangerous aspects of using such chemicals.

Accordingly, a need exists for a simple and inexpensive system which limits exposure to a chemical during dispensing and dilution of the chemical.

The shipping containers for concentrated chemicals also present a significant problem. The residual concentrated chemical inherently retained within an otherwise empty container pose a significant threat to the environment if the container is simply discarded as routine refuse. While appropriate rinsing of the container can substantially alleviate this problem, such a rinsing process further exposes an end-user to the concentrated chemical.

Accordingly, a need also exists for a system which limits exposure to a chemical during rinsing of the chemical container.

SUMMARY OF THE INVENTION

I have developed a system for hermetically dispensing and diluting a concentrated chemical from a sealed container into a dilution tank. In a first embodiment, the system includes (i) a means for hermetically providing fluid communication from the container to the dilution tank, (ii) a means for unsealing the container after the container has been hermetically coupled to the fluid communication means, (iii) a means for hermetically providing fluid flow from a source of water into the dilution tank, and (iv) a means for hermetically directing fluid flow from the source of water into the container for rinsing residual chemical from the container into the dilution tank.

The system prevents exposing either the concentrated or diluted forms of a chemical to the atmosphere during dispensing of the chemical, dilution of the dispensed chemical, and rinsing of the empty container.

In a second embodiment, the system includes (i) a conduit having a main passageway which defines a main run and which is operably couplable at an upstream end to a container of concentrated chemical so as to sealingly place the main run in fluid communication with the container, (ii) a first fitting downstream from the conduit which includes [aa] a main passageway in fluid communication with main passageway of the conduit so as to continue the main run, and (bb) a branch passageway defining a branch run which is in fluid communication with main run so as to define a junction of the main run and the branch run, (iii) a first main valve located within the main run between the upstream end of the conduit and the junction of the branch run and the main run which is operable in a first position for opening the main run to fluid flow and operable in a second position for closing the main run to fluid flow, (iv) a second main valve located within the main run downstream from the junction of the branch run and the main run which is operable in a first position for opening the main run to fluid flow and operable in a second position for closing the main run to fluid flow, (v) a releasable coupling located between the first main valve and the second main valve which is operable in a first mode for permitting disconnection of the system so as to create separate first and second assembly portions and operable in a second mode for sealingly connecting the first and second assembly portions so as to continue the main run between the first and second main valves, and (vi) a first branch valve located within the branch run which is operable in a first position for opening the branch run to fluid flow and operable in a second position for closing the branch run to fluid flow.

The valves permit flow control of concentrated chemical and water through the system and cooperate with the coupling for permitting disconnection of the container from the dilution tank without exposing the user to the concentrated chemical remaining in the container or the diluted chemical retained within the dilution tank.

BRIEF DESCRIPTION OF THE DRAWINGS

FIG. 3 is a cross-sectional side view of the primary conduit portion of the invention depicted in FIG. 1 taken along line 3—3.

FIG. 4 is a perspective view of one embodiment of a bracket useful for supporting a contaner attached to the invention above a dilution tank.

DETAILED DESCRIPTION OF THE INVENTION INCLUDING A BEST MODE

Figure 1:
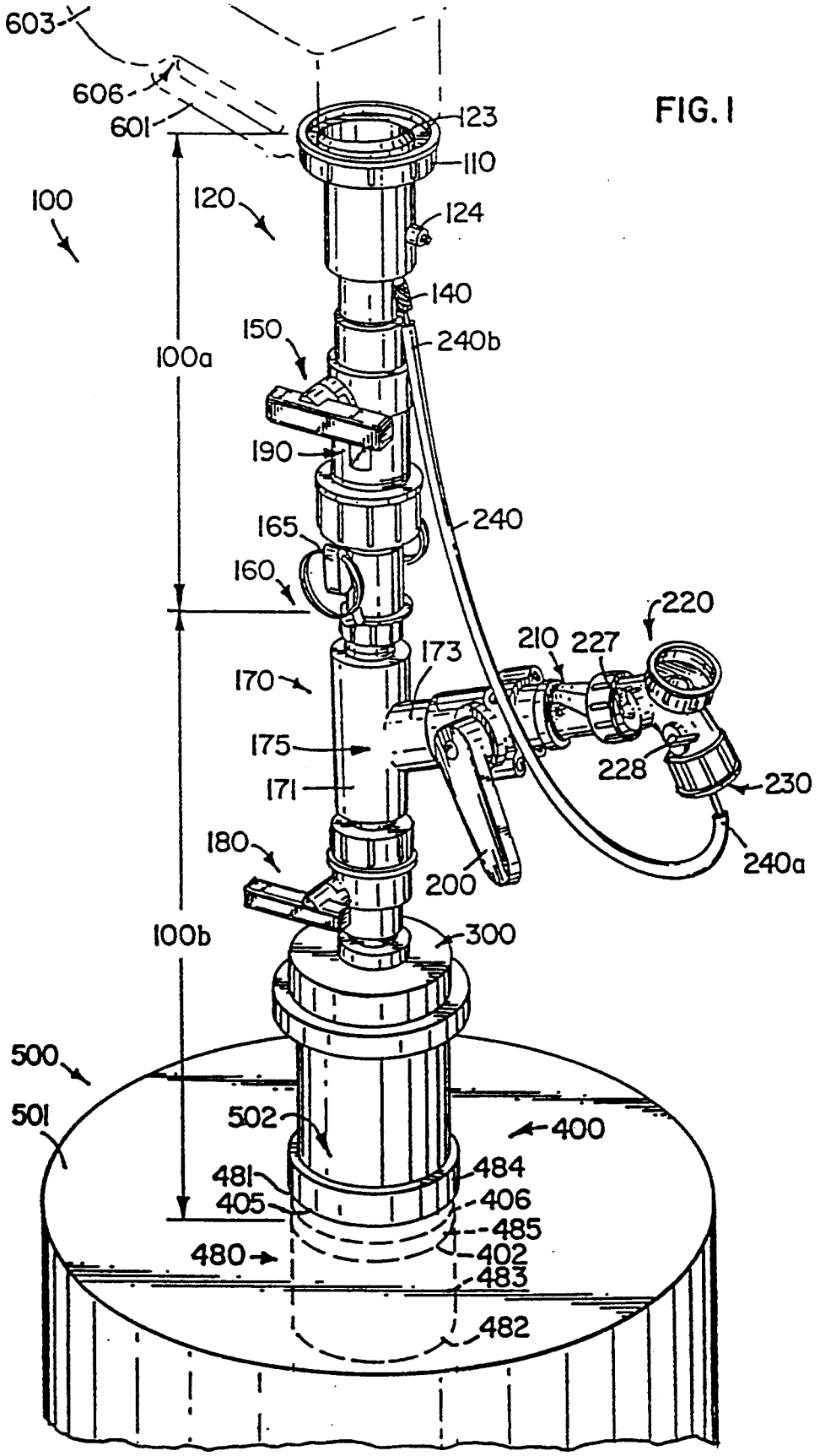
FIG. 1 is a perspective view of one embodiment of the invention.
Figure 2:
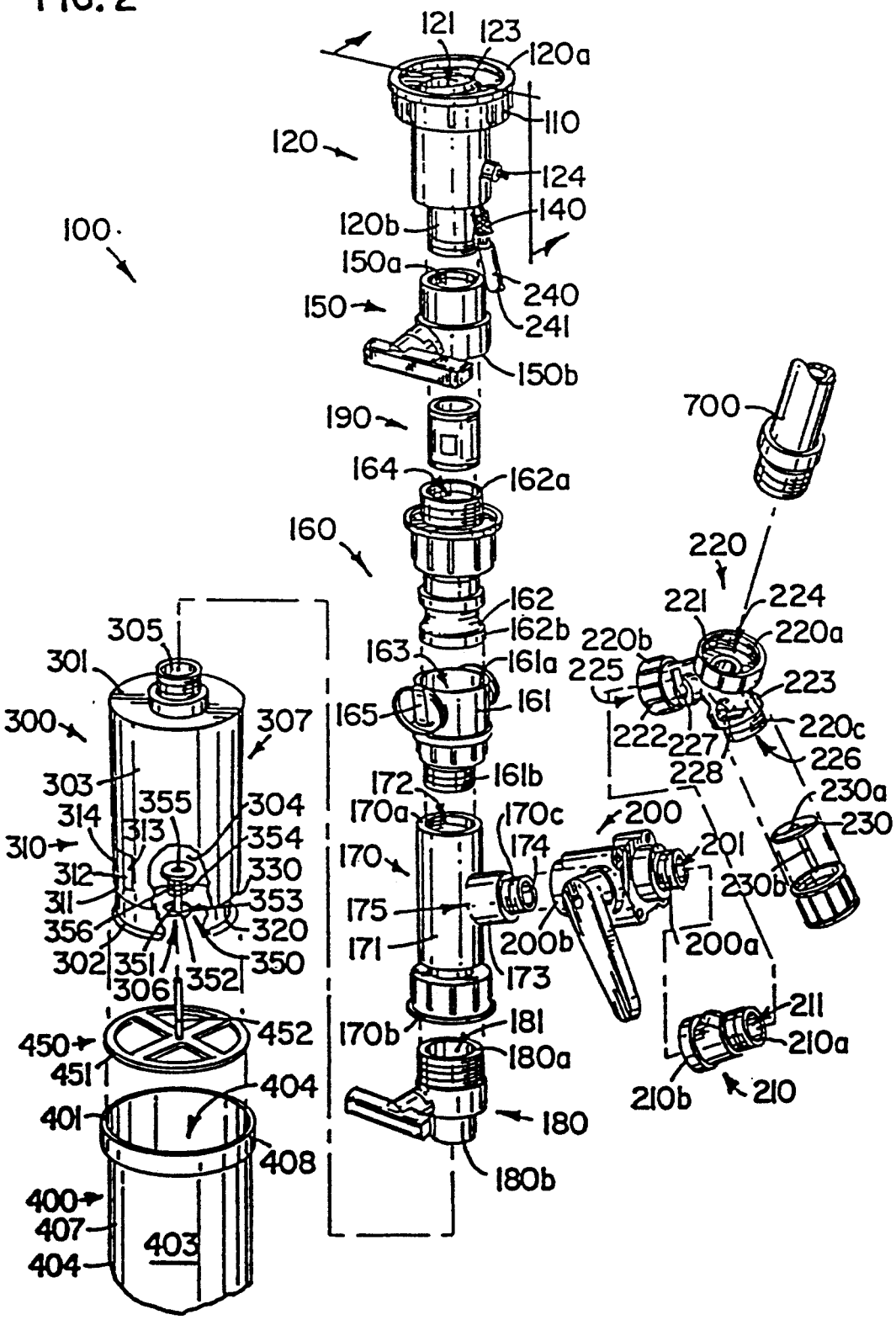
FIG. 2 is an exploded perspective view of the invention depicted in FIG. 1.

The system which I have developed may be utilized to hermetically dispense substantially any chemical and dilute the chemical with substantially any solvent. However, for the purposes of facilitating discussion of the system, the system will be described with respect to the dispensing of a concentrated chemical into a dilution tank where the dispensed chemical is diluted with water.

In addition, while concentrated chemical may flow through the system in both directions depending upon the vertical positioning of the system with respect to the container (above/below), the components of the system will be referenced with respect to an upstream end and a downstream end in accordance with the flow of concentrated chemical through the system when the concentrated chemical is being dispensing from the container into the dilution tank.

NOMENCLATURE

| Nomenclature | |
|---|---|
| 100 | system |
| 100a | upper portion of system |
| 100b | lower portion of system |
| 110 | threaded cap |
| 120 | primary conduit |
| 120a | upstream end of primary conduit |
| 120b | downstream end of primary conduit |
| 121 | main passageway through primary conduit |
| 122 | outer annular flange on primary conduit |
| 123 | inclined annular blade |
| 124 | one-way breather valve |
| 130 | telescoping nozzle |
| 131 | spray head |
| 140 | quick-release coupling |
| 141 | female portion of quick-release coupling |
| 142 | male portion of quick-release coupling |
| 150 | first main valve |
| 150a | upstream end of first main valve |
| 150b | downstream end of first main valve |
| 151 | passage through first main valve |
| 160 | primary coupling |
| 161 | female portion of primary coupling |
| 161a | upstream end of female portion of primary coupling |
| 161b | downstream end of female portion of primary coupling |
| 162 | male portion of primary coupling |
| 162a | upstream end of male portion of primary coupling |
| 162b | downstream end of male portion of primary coupling |
| 163 | passage through female portion of primary coupling |
| 164 | passage through male portion of primary coupling |
| 165 | clamping levers |
| 170 | wye fitting |
| 170a | upstream end of main section on wye fitting |
| 170b | downstream end of main section on wye fitting |
| 170c | upstream end of branch section on wye fitting |
| 171 | main section of wye fitting |
| 172 | main passage through wye fitting |
| 173 | branch section of wye fitting |
| 174 | branch passage through wye fitting |
| 175 | junction of main passage and branch passage |
| 180 | second main valve |
| 180a | upstream end of second main valve |
| 180b | downstream end of second main valve |
| 181 | passage through second main valve |
| 190 | metering gauge |
| 200 | first branch valve |
| 200a | upstream end of first branch valve |
| 200b | downstream end of first branch valve |
| 201 | passage through first branch valve |
| 210 | adaptor |
| 210a | upstream end of adaptor |
| 210b | downstream end of adaptor |
| 211 | passage through adaptor |
| 220 | crotch fitting |
| 220a | first end of crotch fitting |
| 220b | second end of crotch fitting |
| 220c | third end of crotch fitting |
| 221 | first branch of crotch fitting |
| 222 | second branch of crotch fitting |
| 223 | third branch of crotch fitting |
| 224 | passage through first branch of crotch fitting |
| 225 | passage through second branch of crotch fitting |
| 226 | passage through third branch of crotch fitting |
| 227 | valve in second branch of crotch fitting |
| 228 | valve in third branch of crotch fitting |
| 230 | reducer |
| 230a | large end of reducer |
| 230b | small end of reducer |
| 240 | tubing |
| 240a | first end of tubing |
| 240b | second end of tubing |
| 241 | passageway defined by tubing |
| 300 | receptacle |
| 301 | top of receptacle |
| 302 | bottom of receptacle |
| 303 | sidewall of receptacle |
| 304 | cavity defined by receptacle |
| 305 | inlet orifice |
| 306 | outlet orifice |

-continued

| Nomenclature | |
|---|---|
| 307 | volumetric scale |
| 310 | guiding channel |
| 311 | lower longitudinal length of guide channel |
| 312 | lower lateral length of guide channel |
| 313 | upper longitudinal length of guide channel |
| 314 | upper lateral length of guide channel |
| 320 | outer annular rib |
| 330 | outer inclined shoulder |
| 350 | spring biased valve |
| 351 | stem |
| 352 | plug |
| 353 | annular gasket |
| 354 | frame |
| 355 | central orifice through frame |
| 356 | spring |
| 400 | sleeve |
| 401 | top of sleeve |
| 402 | bottom of sleeve |
| 403 | sidewall of sleeve |
| 404 | passageway defined by sleeve |
| 405 | inner annular shoulder |
| 406 | outer annular channel |
| 407 | guiding projection |
| 408 | outer annular shoulder |
| 450 | inset |
| 451 | base of inset |
| 452 | central finger of inset |
| 480 | mesh canister |
| 481 | top of mesh canister |
| 482 | bottom of mesh canister |
| 483 | sidewall of mesh canister |
| 484 | opening through top of mesh canister |
| 485 | annular rib around opening in top of mesh canister |
| 500 | dilution tank |
| 501 | top of dilution tank |
| 502 | opening through top of tank |
| 600 | container |
| 601 | top of container |
| 602 | bottom of container |
| 603 | sidewall of container |
| 604 | opening through top of container |
| 605 | threaded collar surrounding opening |
| 606 | chamber defined by container |
| 700 | hose |
| 800 | bracket |
| 801 | annular portion of bracket |
| 802 | legs |
| 803 | strap |

CONSTRUCTION

Concentrated chemicals such as pesticides and herbicides are generally sold in glass or plastic containers 600 which are provided with a single opening 604 through the top 601 of the container 600. The opening 604 is typically protectively sealed by a mylar film (not shown) bonded to the periphery of a threaded collar 605 surrounding the opening 604.

The system 100 provides for controlled hermetic dispensing of a chemical from a container 600 into a tank 500 and controlled hermetic dilution of the dispensed chemical in the tank 500. The system 100 also provides for hermetic rinsing of the container 600 when emptied with drainage of the residual chemical and rinse water into the dilution tank 500.

A primary conduit 120 of the system 100 is operably attachable to a container 600 by means of an inner threaded cap 110 which encompasses an outer annular flange 122 at the upstream end 120*a* of the primary conduit 120 and threadably engages an outer threaded collar 605 surrounding the opening 604 in the container 600.

The primary conduit 120 defines a main passageway 121 which is placed in fluid communication with the chamber 606 of the container 600 through the opening 604 in the container 600 when the cap 110 engages the collar on the container 600. The main passageway 121 through the primary conduit 120 initiates a main run for directing concentrated chemical (not shown) from the container 600 to the dilution tank 500.

An inclined annular blade 123 is provided at the upstream end 120*a* of the primary conduit 120 surrounding the main passageway 121 through the primary conduit 120 for cutting the seal (not shown) which is secured over the opening 604 in the container 600. The annular blade 123 is recessed such that the seal is cut by the blade 123 only after the container 600 has been sealingly secured to the system 100 by the cap 110. In addition, the blade 123 is operable so that the central portion of the seal cut by the blade 123 remains attached to the container 600 and will not interfere with fluid flow through the system 100.

A one-way breather valve 124 is provided through the primary conduit 120 for permitting aspiration of air into the container 600 during dispensing of concentrated chemical from the container 600.

A wye fitting 170 is provided downstream from the primary conduit 120. The wye fitting 170 includes a main section 171 defining a main passageway 172 and a branch section 173 defining a branch passageway 174. The main passageway 172 is in direct fluid communication with the main passageway 121 of the primary conduit 120 so as to continue the main run. The branch passageway 174 is in fluid communication with the main passageway 172 at a junction point 175.

A first main valve 150 is threadably coupled to the downstream end 120*b* of the primary conduit 120 and the upstream end 170*a* of the main section 171 of the wye fitting 170 for controlling fluid flow through the main run upstream of the junction point 175.

A second main valve 180 is threadably coupled to the downstream end 170*b* of the main section 171 of the wye fitting 170 for controlling fluid flow through the main run downstream from the junction point 175.

A first branch valve 200 is coupled to the upstream end 170*c* of the branch section 173 of the wye fitting 170 for controlling fluid flow through the branch run.

A triple branched crotch fitting 220 is threadably coupled through an adaptor 210 to the upstream end 200*a* of the first branch valve 200 at a second branch 222 of a crotch fitting 220. The first branch 221 of the crotch fitting 220 is coupling to a hose 700 which is in fluid communication with source of pressurized water. The third branch 223 is threaded to a reducer 230 which in turn is coupled to tubing 240.

A second branch valve 227 is provided in the second branch 222 of the crotch fitting 220 for controlling fluid flow through the passageway 225 in the second branch 222. Similarly, a third branch valve 228 is provided in the third branch 223 of the crotch fitting 220 for controlling fluid flow through the passageway 226 in the third branch 223.

A primary coupling 160 is provided within the main run between the first main valve 150 and the wye fitting 170 which is operable in a first mode for permitting disconnection of the system 100 so as to create separate upper 100*a* and lower 100*b* portions of system 100 and operable in a second mode for sealing connecting the upper 100*a* and lower 100*b* sections of the system 100 so as to provide a continuous main run through the system 100.

The male portion 162 of the primary coupling 160 is threadably engaged to the downstream end 150*b* of the first valve 150 while the female portion 161 of the primary coupling 160 is threadably engaged to the upstream end 170*a* of the main section 171 of the wye fitting 170. The female 161 and male 162 portions of the primary coupling 160 are sealingly connected and disconnected by a pair of clamping levers 165 which restrict the periphery of the female portion 161 when placed in an up position and expand the periphery of the female portion 161 when placed in a down position.

A translucent receptacle 300 is threadably engaged to the downstream end 180*b* of the second valve 180 at a threaded inlet orifice 305 in the top 301 of the receptacle 300. The cavity 304 defined by the receptacle 300 is thereby placed in direct fluid communication with the container 600 through the main run of the system 100.

The receptacle 300 includes a volumetric scale 307 along the side wall 303 of the receptacle 300 for measuring the quantity of concentrated chemical dispensed through the system 100 and into the receptacle 300. The quantity of concentrated chemical dispensed into the receptacle 300 may be controlled by operation of the first main valve 150.

Alternatively, a metering gauge 190 may be employed within the main run between the first main valve 150 and the receptacle 300. Such metering gauges 190 for in-line measurement of fluid flow are readily available form such suppliers an Great Plains Industries, Inc. of Wichita, Kans. Placement of the metering gauge 190 upstream of the junction 175 of the main run and the branch run provides for measurement of only the quantity of concentrated chemical flowing through the main run while placement of the metering gauge 190 downstream from the junction 175 permits measurement of both concentrated chemical and diluting solvent passing through the main run.

Concentrated chemical dispensed into the receptacle 300 is released from the receptacle 300 into the dilution tank 500 through an outlet orifice 306 in the bottom 302 of the receptacle 300. The outlet orifice 306 is sealed by a spring biased valve 350 which maintains the valve 350 in a closed position for preventing the flow of fluid from the receptacle 300 into the dilution tank 500. The spring biased valve 350 includes a supporting frame 354 forming a bubble over the outlet orifice 306 in the receptacle 300, a plug 352 over the outlet orifice 306 in the receptacle 300, a stem 351 with one end coupled to the plug 352 and the other end extending through a central orifice 355 in the frame 354, an annular gasket 353 surrounding the outlet orifice 306, and a spring 356 surrounding the stem 351 and retained between the plug 352 and the frame 354 for biasing the plug 352 towards the outlet orifice 306 and against the gasket 353. The frame 354 is securely attached to the bottom 302 of the receptacle 300.

The spring biased valve 350 is forced against the bias and into an open position for releasing the contents of the receptacle 300 when the receptacle 300 is full inserted within a sleeve 400 which includes a central finger 452 for contacting the plug 352 of the spring biased valve 350.

The sleeve 400 includes an inwardly extending guiding projection 407 mated for engagement within a guiding channel 310 in the sidewall 303 of the receptacle 300. The guiding channel 310 includes a lower longitudinal length 311, a lower lateral length 312, an upper longitudinal length 313, and an upper lateral length 314.

The configuration of the guiding channel 310 is such that the spring biased valve 350 remains in the closed position when the guiding projection 407 is retained within the lower lateral length 312 of the guiding channel 310 but is forced into an open position by the finger 452 when the guiding projection 407 is retained within the upper lateral length 314 of the guiding channel 310.

The guiding channel 310 is configured such that the guiding projection 407 may pass from the lower lateral length 312 to the upper lateral length 314 of the guiding channel 310 only by rotating the receptacle 300 with respect to the sleeve 400 after the projection 407 has travelled completely up the lower longitudinal length 311 of the guiding channel 310.

The finger 452 is provided within the sleeve 400 as part of an independent and separate inset 450 which includes the central finger 452 and an annular base 451. The inset 450 is supported within the sleeve 400 by an inner annular shoulder 405 on the sleeve 400 which is proximate the bottom 402 of the sleeve 400. The base 451 of the inset 450 is configured to provide unrestricted passage of fluid through the inset 450 and into the dilution tank 500 while providing sufficient structural integrity to support the central finger 452 against the bias of the spring 356.

The passageway 404 through the sleeve 400 is configured and arranged to sealingly engage the sidewall 303 of the receptacle 300 so as to prevent fluid flow between the receptacle 300 and the sleeve 400.

The sleeve 400 is sealably secured within the opening 502 of a dilution tank 500 by an outer annular shoulder 408 proximate the top 401 of the sleeve 400 which engages the dilution tank 500 around the opening 502 through the dilution tank 500.

There is an outer annular channel 406 on the sleeve 400.

A telescoping nozzle 130 is provided within the main passageway 121 of the primary conduit 120. The telescoping nozzle 130 includes a spray head 131 at one end for providing an effective rinsing spray pattern within the container 600. The telescoping nozzle 130 is coupled to the tubing 240 at the other end so as to provide for pressurized fluid flow to the spray head 131 from the source of pressurized water when the third branch valve 228 is open to fluid flow. The flow of pressurized fluid through the tubing 240 and into the telescoping nozzle 130 causes the telescoping nozzle 130 to telescope into the container 600 and provide a rinsing spray within the container 600 to remove residual concentrated chemical from the container 600. The nozzle 130 is provided in telescoping form so that the nozzle 130 does not interfere with the initial unsealing of the container 600 by the annular blade 123 and provides a more effective rinse of the container 600 than obtainable by a single jet stream directed from inside the main passageway 121 in the primary conduit 120 into the container 600.

In order to facilitate engagement/disengagement of the upper portion 100*a* and lower portion 100*b* of the system 100 the tubing 240 is connected to the telescoping nozzle 130 by means of a quick-release coupling 140 which includes a female portion 141 secured to the telescoping nozzle and a male portion 142 secured to the tubing 240.

The components of the system 100 which include the cap 110, the primary conduit 120, the first valve 150, the primary coupling 160, the wye fitting 170, the second valve 180, the first branch valve 200, the adapter 210, the crotch fitting 220, the reducer 230, the tubing 240 and the receptacle may be constructed from independent components which are then sealably coupled to one another as in the present embodiment or may be molded as any combination thereof so long as the upper portion 100*a* is separable from the lower portion 100*b* of the system 100 at the primary coupling 160 and the quick release coupling 140.

The size of the system 100 including the size of the cap 110, the diameter of the main and branch runs, and the capacity of the retainer 300, are substantially irrelevant to functioning of the system. Selection of sizes is generally based upon a balancing of the competing interests of dispensing rate (increased size =increased dispensing rate) and dispensing accuracy (increased size =decreased dispensing accuracy).

The system 100 may be conveniently employed for dispensing any number of different chemicals from any number of different containers 600 into any number of dilution tanks 500 by simply providing an upper portion 100*a* for each container 600 which may be in concurrent use and a lower portion 100*b* for each dilution tank 500 which may be in concurrent use. For example, custom mixing of fertilizer may be conveniently performed with three upper portions 100*a* and a single lower portion 100*b* by placing the lower portion 100*b* on the dilution tank 500 and each of the upper portions 100*a* on separate containers of a liquid nitrogen source, a liquid phosphorus source, and a liquid potash source.

A mesh canister 480 is provided for facilitating dispensing of powdered and granular chemicals. The mesh canister 480 is constructed with an open mesh bottom 482 and sidewalls 483 sized to retain the powdered or granular chemical while permitting fluid flow therethrough. The mesh canister 480 includes an opening through the top 481 for accepting the bottom 402 of the sleeve 400. An annular rib 485 is provided around the opening 484 in the top 481 of the mesh canister 480 for sealing engagement within an annular channel 406 in the sidewall 403 of the sleeve 400.

Large and/or bulky containers 600 may be supported above the dilution tank 500 by means of a bracket 800. One embodiment of such a bracket includes an elongated annular portion 801 for placement within the opening 502 in the dilution tank 500 around the sleeve 400 and four L-shaped legs 802 extending outwardly and upwardly from the annular portion towards the container 600 which is attached to the primary conduit 120 of the system 100. The container 600 may then be strapped to the legs with strapping 803 for additional support.

OPERATION

Use of the system 100 to dispense a flowable concentrated chemical from a container 600 into a dilution tank 500, dilute the dispensed chemical within the dilution tank 500, and then prepare the dilution tank 500 for use of the diluted chemical, includes the steps of: (i) detaching the upper 100*a* and lower 100*b* portions of the system 100, (ii) closing the first main valve 150 on the upper portion 100*a* of the system 100, (iii) attaching the upper portion 100*a* of the system 100 to the container 600 by threading the cap 110 onto the collar 605 of the container 600 whereby the blade 123 opens the seal (not shown) on the container 600, (iv) closing the second main valve 180, first branch valve 200, second branch valve 227 and third branch valve 228 on the lower portion 100*b* of the system 100, (vi) attaching the lower portion 100b of the system 100 to a source of pressurized water (not shown) by threading the first branch 221 of the crotch fitting 220 onto a hose 700 which is connected to the source of pressurized water, (vii) attaching the upper 100a and lower 100b portions of the system 100 by placing the male portion 162 of the primary coupling 160 within the female portion 161 and clamping the female portion 161 against the male portion 162, (viii) placing the tubing 240 in fluid communication with the telescoping nozzle 130 by coupling the quick release coupling 140, (ix) securing the sleeve 400 within the opening 502 in the dilution tank 500, (x) inverting the system 100 to place the container 600 above the receptacle 300, (xi) inserting the receptacle 300 into the sleeve 400 so as to place the guiding projection 407 on the sleeve 400 within the lower lateral length 312 of the guiding channel 310 on the receptacle 300, (xii) opening the second main valve 180, (xiii) opening the first main valve 150 to permit the desired quantity of concentrated chemical to flow from the container 600 into the receptacle 300 through the main run, (xiv) closing the first valve 150 when the desired quantity of concentrated chemical has been dispensed into the receptacle 300 as indicated by the metering gauge 190 and/or the volumetric scale 307 on the sidewall 303 of the receptacle 300, (xv) rotating the receptacle 300 relative to the sleeve 400 so as to maneuver the guiding projection 407 on the sleeve 400 into the upper lateral length 314 of the guiding channel 310 in the sidewall 303 of the receptacle 300 and thereby open the spring biased valve 350 with the central finger 452 within the sleeve 400, (xvi) opening the first 200 and second 227 branch valves for permitting water to flow through the system 100 and into the dilution tank 500, (xvii) closing the first 200 and second 227 branch valves when the desired quantity of water has been dispensed into the dilution tank 500, (xviii) closing the second main valve 180, (xix) separating the container 600 from the dilution tank 500 by detaching the male 662 and female 661 portions of the primary coupling 160, and (xx) uncoupling the hose 700 from the crotch fitting 220.

Use of the system 100 to rinse out an empty container 600 includes the additional step of opening the third branch valve 228 so as to permit fluid flow from the source of pressurized water to the nozzle 130 after the spring biased valve 350 has been opened in step (xv) so as to permit the rinse water to drain into the dilution tank 500.

The dispensing of excessive concentrated chemical from the container 600 into the receptacle 300 at step (xiii) may be readily corrected at any time prior to the conclusion of step (xv) by simply removing the receptacle 300 from the sleeve 400 and inverting the system 100 over the container with the first 150 and second 180 main valves in the open position and the first branch valve 200 in the closed position so as to return the excessive chemical from the receptacle 300 to the container 600 through the main run.

A powdered and/or granular chemical which is not in flowable form may also be dispensed and diluted with the system 100 without exposing the user to the chemical during dilution by simply (i) removing the receptacle 300 from the sleeve 400, (ii) optionally removing the inset 450 from the sleeve 400, (iii) removing the sleeve 400 from within the dilution tank 500, (iv) snapping the mesh canister 480 onto the bottom 402 of the sleeve 400, (v) returning the sleeve 400 and mesh canister 480 combination into the dilution tank 500 through the opening 502 in the dilution tank 500, (vi) depositing the powdered/granular chemical into the mesh canister 480 through the sleeve 400, (vii) reinserting the receptacle 300 into the sleeve 400 and rotating so as to open the spring biased valve 350, and then (viii) continuing from step (xv) as set forth above for the dispensing of a flowable concentrated chemical.

The specification is provided to aid in a complete nonlimiting understanding of the invention. Since many variations and embodiments of the invention may be made without departing from the spirit and scope of the invention, the scope of the invention resides in the claims hereinafter appended.

I claim:

1. An assembly for hermetically dispensing a concentrated chemical from a container to a dilution tank, comprising:

a means for hermetically coupling a sealed opening in a container to an opening into a dilution tank, a means for unsealing the sealed opening in the container after the container has been hermetically coupled to the dilution tank, an extensible nozzle connected to the coupling means and having a spray head wherein the nozzle is operable for extending the spray head when pressurized fluid is supplied to the spray head into the container through said unsealed opening, a means for hermetically providing fluid flow from a source of a liquid solvent into the dilution tank, and a means for hermetically directing fluid flow from the solvent source into the container through the extensible nozzle for rinsing residual chemical from the container which is then directed into the dilution tank through the unsealed opening in the container.

2. The assembly of claim 1 further comprising (i) a means for measuring the quantity of fluid flowing from the container into the dilution tank through the assembly, and (ii) a mans for controlling the flow of fluid through the assembly from the container into the dilution tank.

3. The assembly of claim 2 further comprising, a receptacle between the fluid communication means and the dilution tank which has an inlet orifice in fluid communication with the fluid communication means, an outlet orifice in fluid communication with the dilution tank, and a cavity between the inlet and outlet orifices operable for temporarily retaining dispensed concentrated chemical prior to release of the chemical into the dilution tank, and a valve over the outlet orifice in the receptacle which is operable in a first position for opening the outlet orifice to fluid flow and operable in a second position for closing the outlet orifice to fluid flow.

4. The assembly of claim 3 wherein the valve over the outlet orifice in the receptacle is biased in the closed position.

5. An assembly for hermetically dispensing a concentrated chemical from a container to a dilution tank, comprising:

a primary conduit having a main passageway which defines a main run and is operably couplable at an upstream end to a container so as to sealingly place the main run in fluid communication with the container, a first fitting downstream from the primary conduit which has (i) a main passageway in fluid communication with the main passageway of the primary conduit so as to continue the main run, and (ii) a branch passageway defining a primary branch run which is in fluid communication with the main run so as to define a junction of the main run and the primary branch run, a first main valve located within the main run between the upstream end of the primary conduit and the junction of the primary branch run and the main run which is operable in a first position for opening the main run to fluid flow and operable in a second position for closing the main run to fluid flow, a second main valve located within the main run downstream from the junction of the primary branch run and the main run which is operable in a first position for opening the main run to fluid flow and operable in a second position for closing the main run to fluid flow, a releasable coupling located between the first main valve and the second main valve operable in a first mode for permitting disconnection of the main run so as to create separate first and second assembly portions and operable in a second mode for sealingly connecting the first and second assembly portions so as t continue the main run between the first and second valves, a first branch valve located within the primary branch run which is operable in a first position for opening the primary branch run to fluid flow and operable in a second position for closing the primary branch run to fluid flow, an extensible nozzle having a spray head at one end which extends into the main run upstream of the first valve and is operable for directing a fluid spray into a container coupled to the upstream end of the primary conduit by extending the spray head into the container when pressurized fluid is supplied to the spray head, and a secondary conduit having a central passageway which is in fluid communication with the nozzle for delivering pressurized fluid flow to the spray head.

6. The assembly of claim 5 further comprising a one-way breather valve in fluid communication with the main run for permitting aspiration of air into the container during hermetic dispensing of chemical from the container.

7. The assembly of claim 5 further, comprising:

a second fitting upstream from the first branch valve which has a main passageway in fluid communication with the branch passageway of the first fitting so as to continue the primary branch run, and a branch passageway defining a secondary branch run which is in fluid communication at a first end thereof with the primary branch run main run so as to define a junction of the primary branch run and the secondary branch run and in fluid communication at a second end thereof with the secondary conduit, and a second branch valve located within the secondary branch run operable in a first position for opening the secondary branch run to fluid flow and operable in a second position for closing the secondary branch run to fluid flow.

8. The assembly of claim 5 further comprising, a receptacle downstream from the second main valve which has an inlet orifice, an outlet orifice, and a cavity which is in fluid communication with the main and primary branch runs through the inlet orifice, and a final valve over the outlet orifice in the receptacle which is operable in a first position for opening the outlet orifice to fluid flow and operable in a second position for closing the outlet orifice to fluid flow.

9. The assembly of claim 8 wherein the receptacle permits external viewing of the level of material within the receptacle and includes a volumetric scale along the sidewall.

10. The assembly of claim 8 wherein the final valve is biased in the closed position.

11. The assembly of claim 10 further comprising a flow meter within the main run downstream from the first valve for measuring the volume of material passing through the main run.

12. The assembly of claim 8 further comprising a sleeve operable for selectively retainer the receptacle in a first position wherein the final valve remains in the biased closed position and in a second position wherein the final valve is urged against the bias to the open position.

13. The assembly of claim 12 wherein (i) the sleeve has an upstream end, a downstream end, and a sidewall and includes an upwardly extending finger proximate the downstream end of the sleeve and an inwardly extending guiding projection along the sidewall of the sleeve, and (ii) the receptacle has an upstream end, a downstream end, and a sidewall and includes a guiding channel in the sidewall which is configured and arranged for accepting the guiding projection so that the receptacle may be selectively secured within the sleeve in a first position with the upwardly extending finger of the sleeve separated from the final valve such that the final valve remains in the biased closed position and in a second position with the upwardly extending finger of the sleeve extending into the outlet orifice in the receptacle and opening the final valve to fluid flow.

14. The assembly of claim 5 further comprising a blade at the upstream end of the conduit operable for piercing a seal over an opening in the container after the container is sealingly coupled to the conduit.

15. The assembly of claim 14 wherein the blade is an arcuate blade surrounding the main passageway through the conduit operable for cutting an arcuate opening through the seal which is greater than 180° and less than 360° such that the entire seal remains attached to the container.

16. An assembly for hermetically dispensing a concentrated chemical from a container to a dilution tank, comprising:

means for hermetically providing fluid communication between a sealed opening in a container and an opening into a dilution tank, a means for unsealing the sealed opening in a container after the container has been hermetically coupled to the fluid communication means, a means for hermetically providing fluid flow from a source of a liquid solvent into the dilution tank, and a means for hermetically directing fluid flow form the solvent source into the container for rinsing residual chemical from the container which is then directed into the dilution tank, a receptacle having an inlet orifice and an outlet orifice which is configured and arranged for receiving fluid flow through the inlet orifice from a container coupled to the fluid communication means and from a solvent source coupled to the fluid flow means prior to flow of the fluids into the dilution tank, a biased valve over the outlet orifice in the receptacle which is operable in the biased position for closing the outlet orifice to fluid flow and operable when moved against the bias for opening the outlet orifice to fluid flow, and a sleeve operable for selectively retaining the receptacle in a first position wherein the biased valve remains in the biased closed position and in a second position wherein the biased valve is urged against the bias into an open position.

* * * * *